US010376940B2

(12) United States Patent
Wong et al.

(10) Patent No.: US 10,376,940 B2
(45) Date of Patent: Aug. 13, 2019

(54) METHOD AND APPARATUS FOR PRODUCING TWO-PIECE BEVERAGE CAN BODIES

(71) Applicant: Rexam Beverage Can Company, Chicago, IL (US)

(72) Inventors: Howard Wong, Chicago, IL (US); Chad Valien, Montgomery, IL (US)

(73) Assignee: REXAM BEVERAGE CAN COMPANY, Broomfield, CO (US)

( * ) Notice: Subject to any disclaimer, the term of this patent is extended or adjusted under 35 U.S.C. 154(b) by 714 days.

(21) Appl. No.: 15/019,712

(22) Filed: Feb. 9, 2016

(65) Prior Publication Data

US 2017/0225212 A1 Aug. 10, 2017

(51) Int. Cl.

| | |
|---|---|
| ***B21C 43/02*** | (2006.01) |
| ***B08B 3/00*** | (2006.01) |
| ***B08B 3/02*** | (2006.01) |
| ***B08B 9/00*** | (2006.01) |
| ***B08B 9/093*** | (2006.01) |
| ***B08B 9/30*** | (2006.01) |
| ***B41F 17/22*** | (2006.01) |
| ***B08B 3/14*** | (2006.01) |
| ***B21D 51/26*** | (2006.01) |

(52) U.S. Cl.

CPC ..... *B21C 43/02* (2013.01); *B08B 3/00* (2013.01); *B08B 3/022* (2013.01); *B08B 3/14* (2013.01); *B08B 9/00* (2013.01); *B08B 9/093* (2013.01); *B08B 9/30* (2013.01); *B41F 17/22* (2013.01); *B21D 51/26* (2013.01); *B41P 2235/26* (2013.01)

(58) Field of Classification Search

None

See application file for complete search history.

(56) References Cited

U.S. PATENT DOCUMENTS 3,252,410 A 5/1966 Stephenson
3,262,460 A 7/1966 Huddle et al.
(Continued)

FOREIGN PATENT DOCUMENTS

WO 00/15364 3/2000

OTHER PUBLICATIONS

International Search Report and Written Opinion dated Sep. 20, 2017 for PCT/US2017/01787 (23 pages).

*Primary Examiner* — Eric W Golightly
*Assistant Examiner* — Arlyn I Rivera-Cordero
(74) *Attorney, Agent, or Firm* — Greer, Burns & Crain, Ltd.

(57) ABSTRACT

A method of cleaning can bodies having a continuous sidewall closed at one end by an integral bottom portion opposite an open end is described. A can body transporter is populated a plurality of can bodies. The transporter transfers can bodies through a can body washer apparatus from an entry end to a delivery end. A plurality of spray bars are located between the entry end and the delivery end and delivers a washing solution to the plurality of can bodies. A substantially constant can body population density is maintained on the can body transporter by controlling a speed of the can body transporter relative to a rate of production of can bodies produced by an upstream can body making apparatus. A time duration of an exposure of the plurality of can bodies to the solution is controlled by regulating delivery of the solution.

26 Claims, 5 Drawing Sheets

(56) References Cited

U.S. PATENT DOCUMENTS

| | | | | |
|---|---|---|---|---|
| 3,504,390 | A | 4/1970 | Wing | |
| 3,952,698 | A | 4/1976 | Beyer et al. | |
| 4,319,930 | A | 3/1982 | Yano et al. | |
| 4,327,756 | A | 5/1982 | Rath | |
| 4,374,681 | A | 2/1983 | Schueneman | |
| 4,616,306 | A | 10/1986 | Kuzma et al. | |
| 5,335,682 | A | 8/1994 | Yoshimura et al. | |
| 5,356,481 | A | 10/1994 | Yoshimura et al. | |
| 6,494,961 | B2 * | 12/2002 | Simpson | C23G 3/023 134/15 |
| 6,551,422 | B1 | 4/2003 | O'Connor | |
| 6,755,202 | B1 | 6/2004 | Scholey et al. | |
| 8,574,492 | B2 * | 11/2013 | Morita | A61L 2/22 134/131 |
| 2002/0148485 | A1 | 10/2002 | Taft et al. | |
| 2003/0024554 | A1 | 2/2003 | Schultz et al. | |
| 2004/0211446 | A1 | 10/2004 | Schultz et al. | |
| 2007/0289905 | A1 | 12/2007 | Sondag | |
| 2009/0106958 | A1 * | 4/2009 | Lanz | D02G 1/12 28/257 |
| 2011/0197923 | A1 * | 8/2011 | Battaglioli | B08B 3/02 134/18 |

* cited by examiner

METHOD AND APPARATUS FOR PRODUCING TWO-PIECE BEVERAGE CAN BODIES

CROSS-REFERENCE TO RELATED APPLICATIONS

N/A

FEDERALLY SPONSORED RESEARCH OR DEVELOPMENT

N/A

TECHNICAL FIELD

The invention relates to the production of beverage containers; more particularly, the invention relates to production of metallic can bodies having a sidewall integral with an enclosed bottom portion which is opposite an open end.

BACKGROUND OF THE INVENTION

Two-piece cans are widely used in the beverage industry to package soft drinks, alcoholic drinks, and the like. These two-piece beverage cans typically include a thin-walled tubular body portion having an integral closed end opposite an open end. The open end is subsequently sealed by a can end (also known as a lid) once the can body has been filled with a liquid beverage.

Can bodies are produced from a metal sheet product, typically aluminum or steel. The aluminum or steel sheet arrives at the can manufacturing plant in very large coils. The sheet is fed continuously from an uncoiler or payoff reel into a cupping press which cuts out thousands of disks per minute and forms them into shallow cups. This is called the blank and draw process.

The shallow cups are transported to a bodymaker where the can body begins to take its final shape. In the bodymaker, the shallow cup goes through a process called draw and iron or "DI". During DI, the shallow cup is placed in front of a moving ram which forces it through a series of precision rings, each a little smaller than the previous. This reduces the thickness of the metal (wall ironing) and, as a result, the can gets taller. At the end of the stroke the bottom is formed, and the can body is removed from the ram.

A trimmer shears material excess about the open end of the can body. This trimming process insures that the can body is the correct height, and that the rim about the open end is uniform and free of earring (misshapen metal). Again, the surplus material from this process is recycled.

The trimmed can bodies then pass through highly efficient washers to remove lubricants used during the forming process and to prepare the can body outer surface for coating and printing. Cans are then dried in a drier or oven.

Depending on customer and design requirements, the outer surface of the can bodies may be externally coated with a white or clear base coat at a base coater station.

The next step is a highly sophisticated decorator, which applies a design to the outer surface of the can body using up to six colors. All six colors are printed onto the can body in the same operation. A clear-coat over-varnish is sometimes added to the printed can bodies to give a glossy finish.

Next, the inner surface of each can body is sprayed with a coating. This special layer is added to protect the product in the can from interaction with the metal of the can body.

The decorated can bodies are then passed through a necker/flanger which reduces the diameter of the open end of the can body. This gives the can bodies the characteristic neck shape. Here, the diameter of the top of the can is reduced or "necked-in". The top of the can body is flanged outwards to enable the can end to be seamed to the can body after the can bodies are filled with a liquid beverage.

Can body decorating is an important step in the manufacturing process. Beverage companies often seek to differentiate their brands based on the look of the containers that hold their products. Any deviation from the design of the art on the can body is undesirable from a beverage company's point of view. Therefore, it is very important to manufacturers that their can body decorating machines operate in a manner that does not introduce variability in the decorations exhibited from one can body to the next in a plurality of consecutively decorated can bodies.

Additionally, the economics associated with can body production make it highly desirable for the can body manufacturing process to take as little time as possible. In other words, manufacturers seek to increase production speeds whenever possible. However, an increased speed in one process can lead to an undesirable result in a subsequent manufacturing step.

One difficulty encountered in can body decorating occurs during the transfer of the can bodies to and from the decorating apparatus. Additionally, the can bodies themselves may exhibited voids, i.e. portions having no ink in locations that should exhibit inked decoration.

The problems addressed by the present invention can be stated as follows: In a manufacturing process to produce can bodies for a two-piece beverage container, how might can body performance within a can body decorating apparatus be improved and how might visual results achieved by the can body decorating apparatus be improved.

The present invention is provided to solve the problems discussed above and other problems, and to provide advantages and aspects not provided by prior end closures of this type. A full discussion of the features and advantages of the present invention is deferred to the following detailed description, which proceeds with reference to the accompanying drawings.

SUMMARY OF THE INVENTION

A first aspect of the invention is a method of cleaning can bodies having a continuous sidewall closed at one end by an integral bottom portion opposite an open end, the method comprising the steps of populating a can body transporter with a plurality of can bodies, wherein the transporter transfers can bodies through a can body washer apparatus from an entry end to a delivery end of the can body washer apparatus, wherein a plurality of spray bars located between the entry end and the delivery end delivers a washing solution to the plurality of can bodies; maintaining a substantially constant can body population density on the can body transporter by controlling a speed of the can body transporter relative to a rate of production of can bodies produced by a can body manufacturing apparatus upstream of the can body washer apparatus; and controlling a time duration of an exposure of the plurality of can bodies to the washing solution by regulating delivery of the washing solution from the spray bars. An aspect of the invention is one, any or all of prior aspects in this paragraph up through the first aspect in this paragraph, wherein the controlling the time duration step includes reducing a first flow of the washing solution through a first spray bar wherein the first flow through the first spray bar is negligible relative to a second flow of the washing solution through a second spray bar. An aspect of the invention is one, any or all of prior aspects in this paragraph up through the first aspect in this paragraph, wherein the controlling the time duration step includes sending a signal from a controller to a valve located between a reservoir of the washing solution and the first spray bar to substantially eliminate the first flow. An aspect of the invention is one, any or all of prior aspects in this paragraph up through the first aspect in this paragraph, wherein the controlling the time duration step includes maintaining a substantially constant spray angle measured from a vertical axis of the washing solution delivered from a first spray bar in the plurality of spray bars. An aspect of the invention is one, any or all of prior aspects in this paragraph up through the first aspect in this paragraph, further comprising the step of maintaining a concentration of a washing solution component within the washing solution located in a reservoir by sending a signal corresponding to an actual concentration of the washing solution component within the washing solution to a controller wherein the controller outputs an activation signal to a regulator responsive to the signal which triggers an automated addition of the washing solution component to the reservoir to increase the concentration of the washing solution component in the washing solution. An aspect of the invention is one, any or all of prior aspects in this paragraph up through the first aspect in this paragraph, wherein the concentration is an acid concentration. An aspect of the invention is one, any or all of prior aspects in this paragraph up through the first aspect in this paragraph, wherein the concentration is a surfactant concentration. An aspect of the invention is one, any or all of prior aspects in this paragraph up through the first aspect in this paragraph, wherein the washing solution comprises an acid component and a surfactant component, and the method further comprises the step of maintaining an acid concentration and a surfactant concentration within the washing solution located in a reservoir by sending a signal corresponding to an actual concentration of the acid component within the washing solution to a controller wherein the controller outputs an activation signal to a regulator responsive to the signal which triggers an automated addition of the acid component to the reservoir to increase the acid concentration in the washing solution and by sending a second signal corresponding to an actual concentration of the surfactant component within the washing solution to a controller wherein the controller outputs a second activation signal to a second regulator responsive to the second signal which triggers an automated addition of the surfactant component to the reservoir to increase the surfactant concentration in the washing solution. An aspect of the invention is one, any or all of prior aspects in this paragraph up through the first aspect in this paragraph, further comprising the step of establishing a historical database stored on a computer memory including data related to volumes and timing of additions of the acid component and the surfactant component to the washing solution and including a software routine on the computer memory which uses the historical data to control the acid and surfactant concentrations in the washing solution on a substantially continuously basis. An aspect of the invention is one, any or all of prior aspects in this paragraph up through the first aspect in this paragraph, wherein the washing solution is fed from a source of washing solution to a header pipe and from the header pipe to the plurality of spray bars, wherein a pressure within the header pipe is maintained substantially constant as the controlling the time duration step is performed. An aspect of the invention is one, any or all of prior aspects in this paragraph up through the first aspect in this paragraph, wherein an angle of a sprayed washing solution as measured from a vertical axis remains substantially constant from a first spray bar when a flow of the washing solution through a second spray bar is substantially stopped. An aspect of the invention is one, any or all of prior aspects in this paragraph up through the first aspect in this paragraph, wherein a volume of washing solution delivered to the plurality of can bodies is reduced while maintaining a pressure in a header pipe which delivers the washing solution to the plurality of spray bars. An aspect of the invention is one, any or all of prior aspects in this paragraph up through the first aspect in this paragraph, wherein a spray angle as measured from a vertical axis from at least one of the spray bars in the plurality of spray bars is maintained substantially constant. An aspect of the invention is one, any or all of prior aspects in this paragraph up through the first aspect in this paragraph, wherein a controller uses a proportional, integral and derivative algorithm to control a volume of washing solution that reaches the plurality of can bodies by maintaining a substantially constant spray pressure in a header pipe that delivers the washing solution to the plurality of spray bars and by controlling the exposure time of the plurality of can bodies to the washing solution by regulating a series of valves. An aspect of the invention is one, any or all of prior aspects in this paragraph up through the first aspect in this paragraph, wherein the controller utilizes a software that incorporates the proportional, integral and derivative algorithm.

A second aspect of the invention is a method of cleaning can bodies having a continuous sidewall closed at one end by an integral bottom portion opposite an open end, the method comprising the steps of substantially continuously monitoring a concentration of a component within a washing solution using an electronic monitor; sending a signal corresponding to a concentration of the component in the washing solution from the monitor to a controller; and controlling activation of an electronic regulator in response to the signal which controls volumetric additions of the component to the washing solution. An aspect of the invention is one, any or all of prior aspects in this paragraph up through the second aspect in this paragraph, wherein the step of controlling activation of the electronic regulator is performed substantially continuously such that volumetric additions of the component are substantially continuously added to the washing solutions. An aspect of the invention is one, any or all of prior aspects in this paragraph up through the second aspect in this paragraph, further comprising the step of populating a can body transporter with a plurality of can bodies, wherein the transporter transfers can bodies through a can body washer apparatus from an entry end to a delivery end of the can body washer apparatus, wherein a plurality of spray bars located between the entry end and the delivery end delivers a washing solution to the plurality of can bodies, and wherein the step of controlling activation of the electronic regulator is performed continuously while the transporter is transferring can bodies from the entry end to the delivery end of the can body washer apparatus. An aspect of the invention is one, any or all of prior aspects in this paragraph up through the second aspect in this paragraph, further comprising the step of maintaining a substantially constant can body population density on the can body transporter by controlling a speed of the can body transporter based on a rate of production of can bodies produced by a can body manufacturing apparatus upstream of the can body washer apparatus. An aspect of the invention is one, any or all of prior aspects in this paragraph up through the second aspect in this paragraph, further comprising the step of controlling a time duration of an exposure of the plurality of can bodies to the washing solution by regulating delivery of the washing solution from the spray bars. An aspect of the invention is one, any or all of prior aspects in this paragraph up through the second aspect in this paragraph, wherein the controlling the time duration step includes reducing a first flow of the washing solution through a first spray bar wherein the first flow through the first spray bar is negligible relative to a second flow of the washing solution through a second spray bar. An aspect of the invention is one, any or all of prior aspects in this paragraph up through the second aspect in this paragraph, wherein the controlling the time duration step includes sending a signal from a controller to a valve located between a reservoir of the washing solution and the first spray bar to substantially eliminate the first flow. An aspect of the invention is one, any or all of prior aspects in this paragraph up through the second aspect in this paragraph, wherein the step of controlling activation of the electronic regulator is performed continuously such that volumetric additions of the component are continuously added to the washing solutions An aspect of the invention is one, any or all of prior aspects in this paragraph up through the second aspect in this paragraph, wherein the controller uses a proportional, integral and derivative algorithm to reduce an offset of the solution component concentration to zero wherein a true steady state mode of operation in the washing solution component concentration in the washing solution. An aspect of the invention is one, any or all of prior aspects in this paragraph up through the second aspect in this paragraph, wherein the step of substantially continuously monitoring a concentration of a component within a washing solution using an electronic monitor is performed continuously. An aspect of the invention is one, any or all of prior aspects in this paragraph up through the first aspect in this paragraph, wherein the controller utilizes a software that incorporates the proportional, integral and derivative algorithm.

A third aspect of the invention is a method of improving a washing stage of a plurality of can bodies in a can body manufacturing process comprising a plurality of can body forming apparatuses and a can body decorating apparatus comprising the steps of maintaining a can body population density on a can body transporter through a can body washer apparatus by reducing a speed of the can body transporter in response to a change in a manufacturing rate of an upstream can body forming apparatus, varying an exposure time of the plurality of can bodies to a washing solution in response to the speed of the transporter by reducing a first flow of the washing solution through a first flow bar relative to a second flow of the washing solution through a second flow bar, continuously monitoring a concentration of a component in the washing solution, and continuously adding a volume of the component to the washing solution in response to the monitoring of the concentration. An aspect of the invention is one, any or all of prior aspects in this paragraph up through the third aspect in this paragraph, wherein the first flow of the washing solution is substantially eliminated in response to a decrease in the manufacturing rate of the upstream can body forming apparatus.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which.

DETAILED DESCRIPTION

Figure 1:
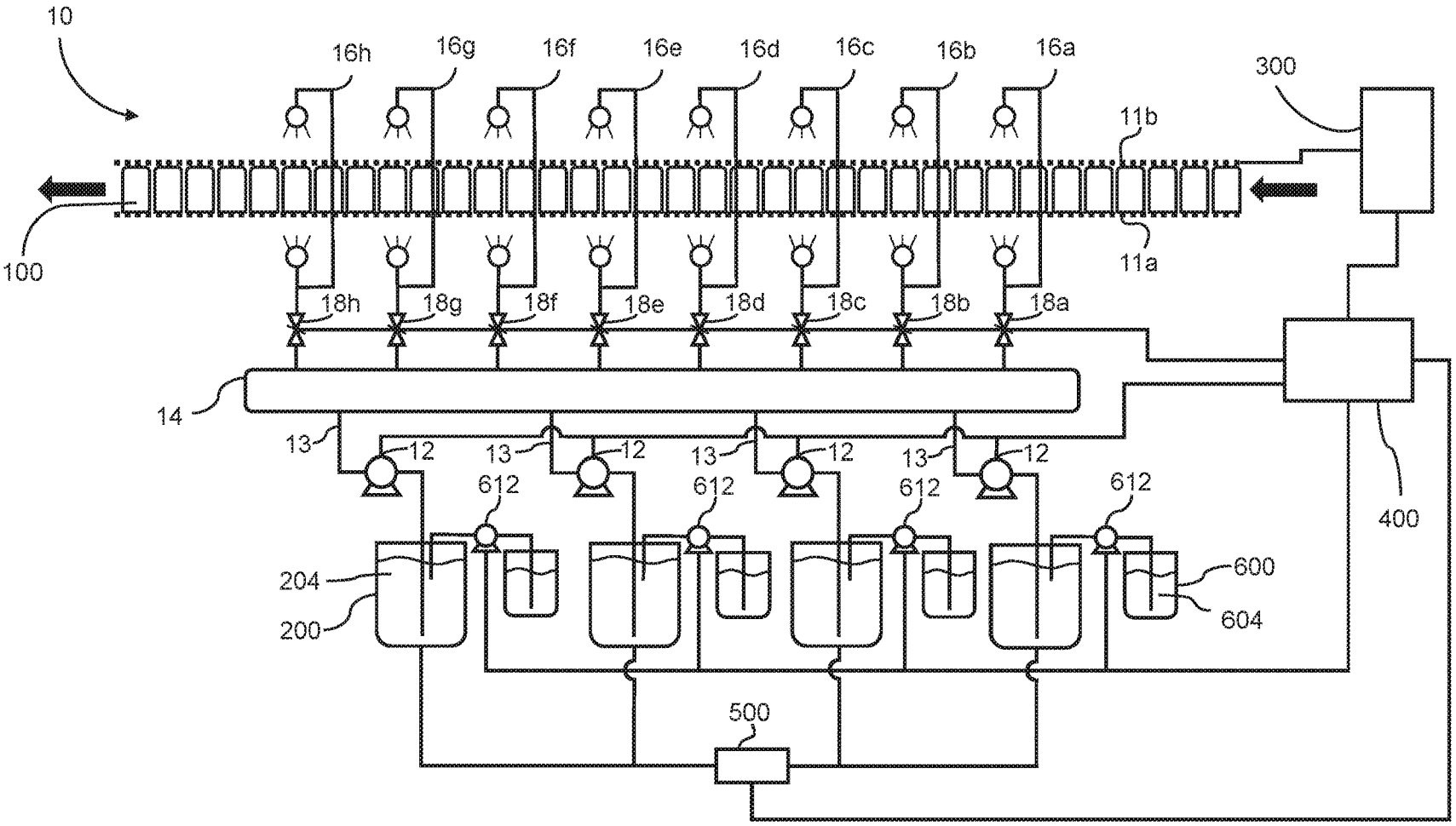
FIG. 1 is a schematic depiction of a stage in a can body washer apparatus of the present invention.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Can bodies for two-piece beverage containers are typically produced by a manufacturing process that includes a washing/rinsing step subsequent to blanking, cupping and draw and ironing processes and before basecoating and printing or decorating steps. The term "washing step" as used herein includes a series of washing and surface treatment processes (also called stages) including "pre-wash" for the removal of lubricant used in preceding forming operations, "chemical treatment" for treating metal surfaces by chemical solutions, and "post-wash" for removing chemical solutions and final rinsing.

One washer apparatus for drawn and ironed aluminum can bodies comprises approximately six to eight stages. A pre-rinse stage rinses the off excess coolant from prior metal cutting and forming stages. A pre-wash stage begins the cleaning process using a recirculating bath. A wash stage cleans the can bodies using surfactants and acid. A plurality of rinse stages clean off the chemistry from the wash stage and flush the can body for the next processes. A treatment stage may prepare the can body for decoration by treating the can body with certain chemicals. Another rinse stage cleans off the chemicals from the treatment stage. A final rinse stage sprays the can bodies with de-ionized water.

If an upstream manufacturing process (i.e. a prior process to the washer apparatus in a can body manufacturing system) slows for any reason, a belt speed through the washer apparatus typically slows wherein a residence time of the can bodies within the washer apparatus increases. Thus, under these circumstances, each can body in a plurality of sequentially washed can bodies will not receive an identical volume of washer solution because the residence time within the washer apparatus of each can body in the plurality of sequentially washed can bodies will not be identical. In other words, one or more of the can bodies in the plurality of sequentially washed can bodies will receive a greater volume of washing solution owing to the increased residence time in the washer apparatus caused by a decrease in the manufacturing process rate which causes the speed of the belt or belts in the washer apparatus to slow to compensate for the manufacturing process rate decrease. To combat some of this, a pressure of the washer solution delivery is decreased; however, the pressure decrease also decreases an angle at which the washer solution 204 is delivered by spray bars to the can bodies from a first angle to a deleterious or unfavorable second angle making it difficult to achieve a proper and accurate volume of washing solution 204 delivered to each can body. See FIGS. 2-4.

For purposes of the description of the present invention, a second stage washer apparatus 10 is illustrated schematically. It would be understood by one of ordinary skill in the art that the principles of the present invention can be employed on any similar type of can body washer apparatus or any stage of the same, for example those manufactured by Cincinnati Industrial Machinery.

The can body washer apparatus 10 of the present invention includes a can body transporter which transfers can bodies through the washer apparatus 10 from an entry end to a delivery end. The can body transporter is typically an endless (or continuous) belt 11*a* or a mat. The belt 11*a* supports an open end of can bodies 100 as they traverse through the washer apparatus 10. A closed end of the can bodies 100 may be supported by a second or upper belt 11*b* which serves to prevent unwanted movement, such as tipping caused by the pressurized delivery of liquids, to the can bodies 100 during cleaning.

Pumps 12 are in fluid communication with one or more reservoirs 200 containing a washing solution 204. The pumps 12 deliver the washing solution 204 via supply tubes 13 to a header pipe 14. In the embodiments illustrated, each pump 12 controls two spray bars.

In a typical washer apparatus, the washing solution 204 is an acidic-based solution comprising two components. One component is hydrofluoric acid that is primarily used to etch and sequester aluminum fines. The second component is a sulfuric acid-based cleaner that may include ferric sulfate (an additional etching component) and surfactants that is used to remove and sequester organic soils.

Hydrofluoric acid concentration in the solution is typically controlled based on can body count, i.e. a predetermined number of can bodies receiving a wash cycle in the solution. A set volume or mass of hydrofluoric acid is added based on the predetermined number of can bodies conveyed through a washer apparatus 10 and washed. This can also be controlled by a probe.

The sulfuric acid/surfactant-based concentration is typically controlled based on conductivity, which in turn determines the level of acidity in a particular stage of the washing process.

A sulfuric acid concentration is typically maintained by establishing a desired level of acidity set point and a control band width. Both the set point concentration and band width concentration are based on acid/base titrations that are routinely carried out by a chemical process operator. When a lower concentration value of the band width is reached, sulfuric acid is added to the solution until an upper concentration value of the band width is reached, wherein the addition of the sulfuric acid is ceased. No sulfuric acid/surfactant is added to the stage when the measured concentration is within the band width.

However, a close monitoring of this method of adding sulfuric/surfactant-based component to a washing solution 204 shows significant time gaps between acid additions. For example, a band width of 0.1 mil (from titration readings) could yield a time gap of 15 to 40 minutes between acid additions. A process may add acid into a washing solution, then wait 15-40 minutes for the acid concentration to move outside a set range (i.e. the band width). At which point, the apparatus automatically dumps or adds a batch of acid into the solution.

This creates a high degree of variability in the washing solution concentration during 20-40 minute cycle. In other words, acid concentration is typically high at the beginning of the cycle and also immediately subsequent to the addition of the acid. The acid concentration drops as the cycle reaches its end, and more acid is added. The washing solution 204 cleans the can bodies 100; however, overexposure to the washing solution 204 can etch or roughen a surface of the can bodies 100. The more etching that takes place, the rougher the can body surface area will be. This results in increased can body surface area. The etched can body surface has more oxide, and it is more abrasive. This can cause manufacturing difficulty, for example in transferring can bodies 100 to a can body decorator apparatus, because a surface finish on the can bodies becomes rough etched creating a surface finish similar to fine grit sandpaper. A smooth surface finish is more desirable in the manufacture of can bodies 100 because the can body sidewalls must fully engage one another during transfer, and the etched sidewalls of overexposed can bodies do not fully or adequately engage one another along the sidewall of the adjacent can bodies 100.

The header pipe 14 is fluidly connected to eight spray bars 16*a-h*. Each spray bar 16*a-f* may comprise an upwardly directed sprayer and a downwardly connected sprayer. For purposes of this discussion, the term the term "spray bar" is intended to include either or both of an upwardly directed sprayer and a downwardly directed sprayer.

Can bodies 100 traverse through the washer apparatus 10 shown in FIG. 1 from right to left as indicated by the arrows at the entry and delivery ends of the washer apparatus 10. Thus, can bodies 100 will encounter spray bar 16*a* followed by spray bar 16*b*, followed by spray bar 16*c*, and so forth until the can bodies 100 pass spray bar 16*h* wherein the can bodies 100 are discharged from the washer apparatus 10 for further processing in keeping with the industry standard of two-piece beverage container can body production.

The present invention incorporates valves 18*a-h* between the pumps 12 and the spray bars 16*a-h*. These valves 18*a-h* are controllable to regulate washing solution 204 flow to the spray bars 16*a-h*. This will be explained in detail below. The valves 18*a-h* are preferably butterfly valves that can be used to terminate washing solution 204 flow to a corresponding spray bar 16*a-h*. The present invention uses the valves 18*a-h* to physically shorten the stage of the washer apparatus shown in FIG. 1.

A controller 300 is provided to adjust the speed of the continuous belts 11*a,b*. This controller 300 of the belt speed can be a manual controller but is preferably an electronic or electro-mechanical controller that is responsive to the can body manufacturing processes that precede the washer apparatus 10. For example, if the D&I process slows for some reason, the belt speed will decrease so there are not large gaps or spaces between the can bodies 100 on the continuous belts 11*a,b*. This is a standard protocol in the production of can bodies 100 for two-piece beverage containers.

A second controller 400 is provided to activate and deactivate (i.e. close and open) the valves 18*a-h* and control a concentration of the washing solution 204 in the reservoir 200 and control the pumps 12 which can be used to vary a washing solution 204 pressure in the header pipe 14. This second controller 400 can be a separate element or incorporated with the first controller 300, provided the first controller 300 has such capability.

A monitor 500 at least substantially continuously, preferably continuously, measures a concentration of the washing solution 204 and continuously outputs measurement results to the second controller 400. The concentration results are used by the second controller 400 to control a delivery from a supply or reservoir 600 of one or more washing solution components 604 to the washing solution 204 in reservoir 200. The second controller 400 activates and regulates a pump 612 or other means of transfer to add the component 604 to the washing solution 204 at least substantially continuously, preferably continuously, rather than in batches. Here, "at least substantially continuously" refers to at least on a per minute basis.

Surfactant concentration and acid concentration in the washing solution 204 are also critical to the methods and apparatuses described herein. Therefore, in one aspect of the invention, a surfactant (e.g. a detergent) concentration in the reservoirs 200 is measured independently of the acid concentration measurement, both in an at least substantially constant manner as described above. In this aspect, the acid is added to the washing solution 204, and surfactant is subsequently metered into the washing solution 204, again in at least a substantially continuous manner. Acid concentration is controlled by measurement of pH or conductivity, and surfactant concentration is controlled by measuring the surface tension of the washing solution 204. This aspect provides the further benefit of improving control over the desired surface integrity of the can body from a surface finish or roughness point of view while improving control over the can bodies' a cleanliness. Thus, according to this aspect, a can body can be produced that is loaded into a can decorator without incident while and can body cleanliness is controlled independently.

Figure 5:
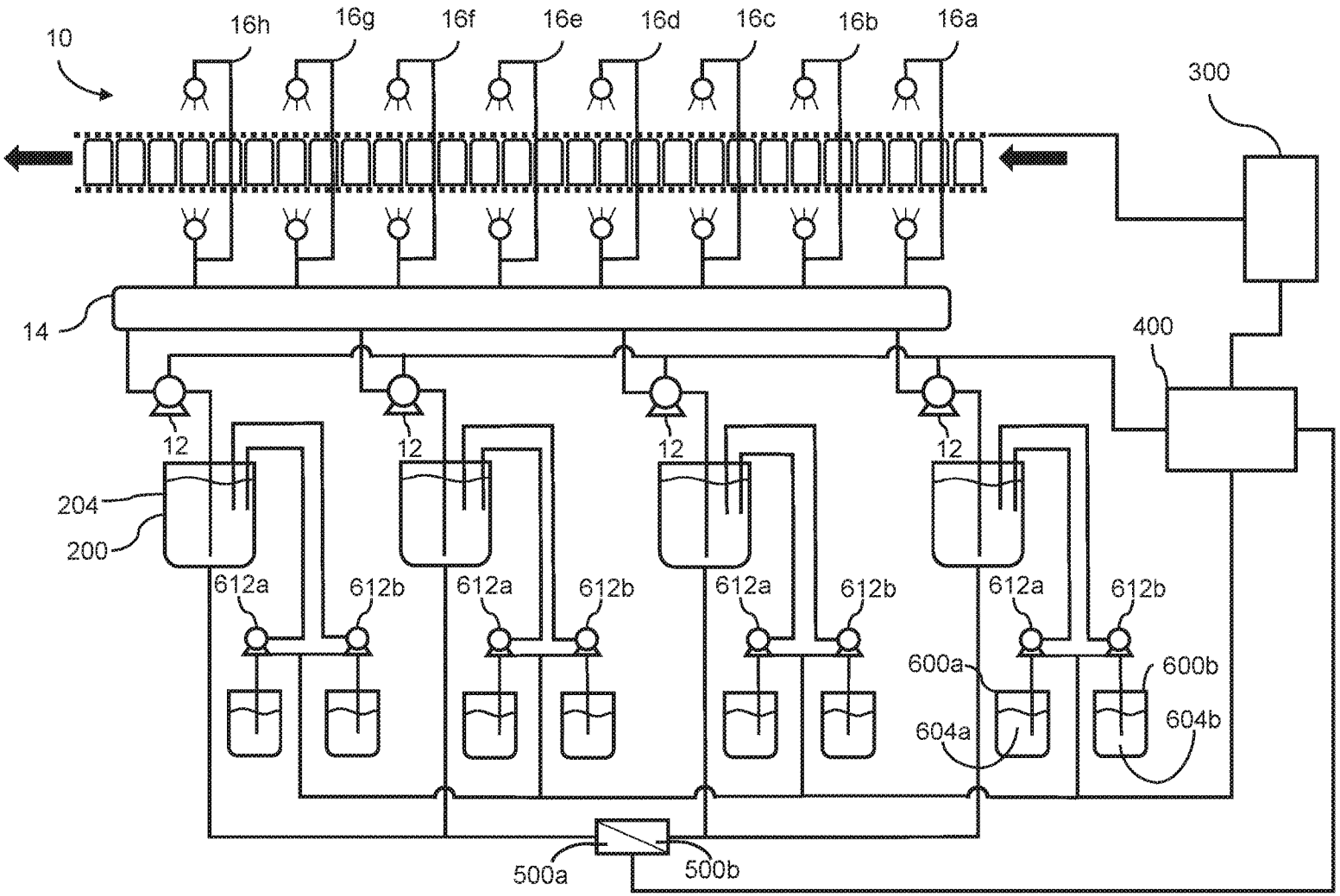
FIG. 5 is a schematic depiction of a stage in a can body washer apparatus of the present invention.

As illustrated in FIG. 5, monitors 500*a,b* at least substantially continuously, preferably continuously, measure acid concentration and surfactant concentration of the washing solution 204, respectively, and continuously output measurement results to the second controller 400. The concentration results are used by the second controller 400 to control a delivery of an acid component 604*a* from an acid supply or reservoir 600*a* and a surfactant component 604*b* from a surfactant supply or reservoir 600*b* to the washing solution 204 in reservoir 200. The second controller 400 activates and regulates a pumps 612*a,b* or other means of transfer to add the components 604*a,b* to the washing solution 204 at least substantially continuously, preferably continuously, rather than in batches. Here, "at least substantially continuously" refers to at least on a per minute basis.

Figure 3:
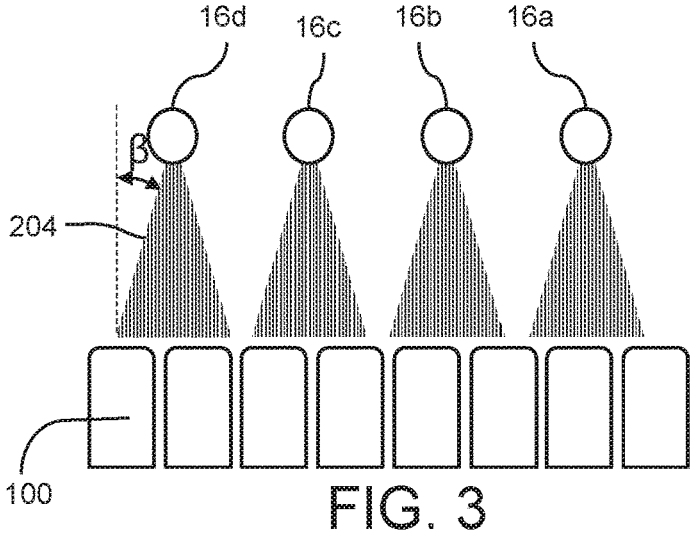
FIG. 3 is a drawing showing washing solution delivered from spray bars wherein a delivery pressure is reduced causing a decrease in the delivery angle illustrated in FIG. 2 which results in a loss of the overlapping of the solution spray from adjacent spray bars.
Figure 4:
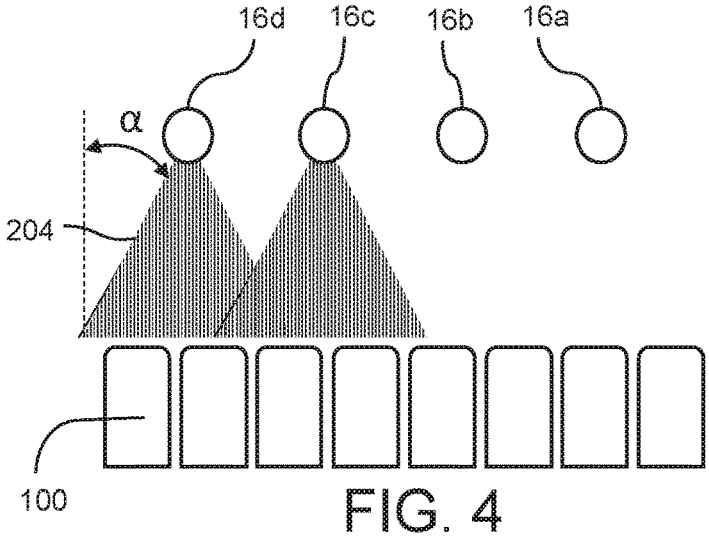
FIG. 4 is a drawing showing a condition wherein solution delivery from two out of four spray bars is turned off or eliminated according to an embodiment of the present invention.

In one illustrative example, can bodies are loaded into a can decorating apparatus, such as the one described in U.S. patent application Ser. No. 14/14,5045, which is hereby incorporated by reference as if fully set forth herein and for at least one particular purpose of describing a conventional can decorating apparatus as illustrated in FIGS. 1 and 3, and explained in Paragraphs [0002] to [0013]. The can bodies are loaded into the can decorator apparatus at a rate of 2000 can bodies per minute. By controlling the acid and surfactant concentrations independently, a suitable surface finish (i.e. without excessive surface etching) and a suitable cleanliness can be maintained independently rather than as a combination solution as currently practiced in the art today.

Figure 7:
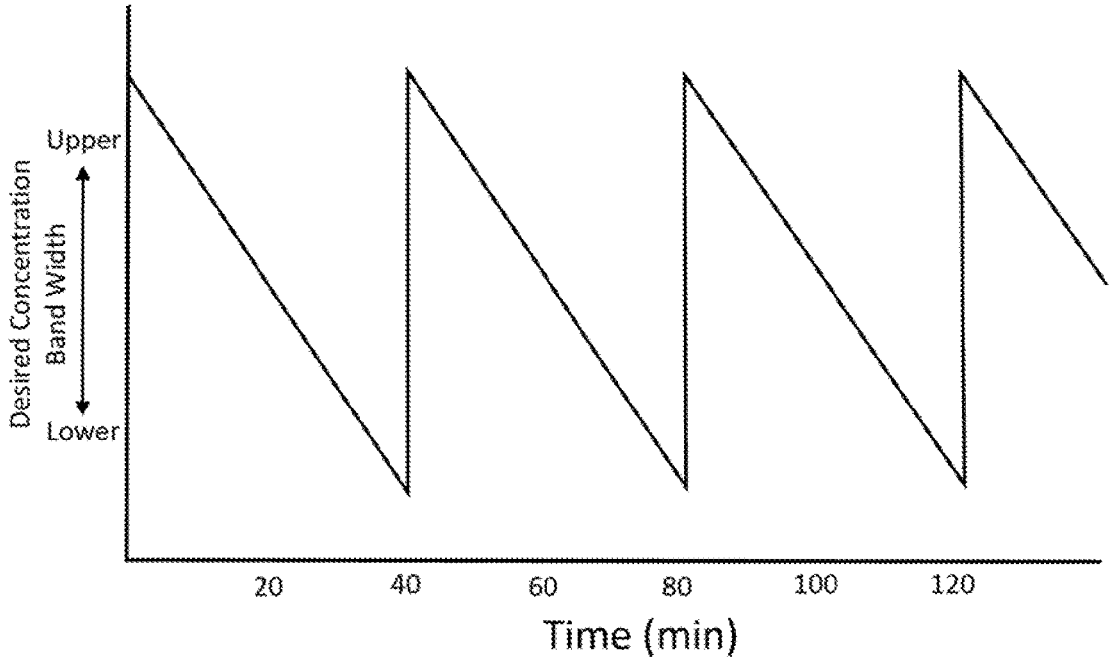
FIG. 7 Prior Art
FIG. 7 is a graphic representation of acid concentrations taken in a washer solution reservoir when the concentration within the reservoir is controlled according to a prior art method.
Figure 8:
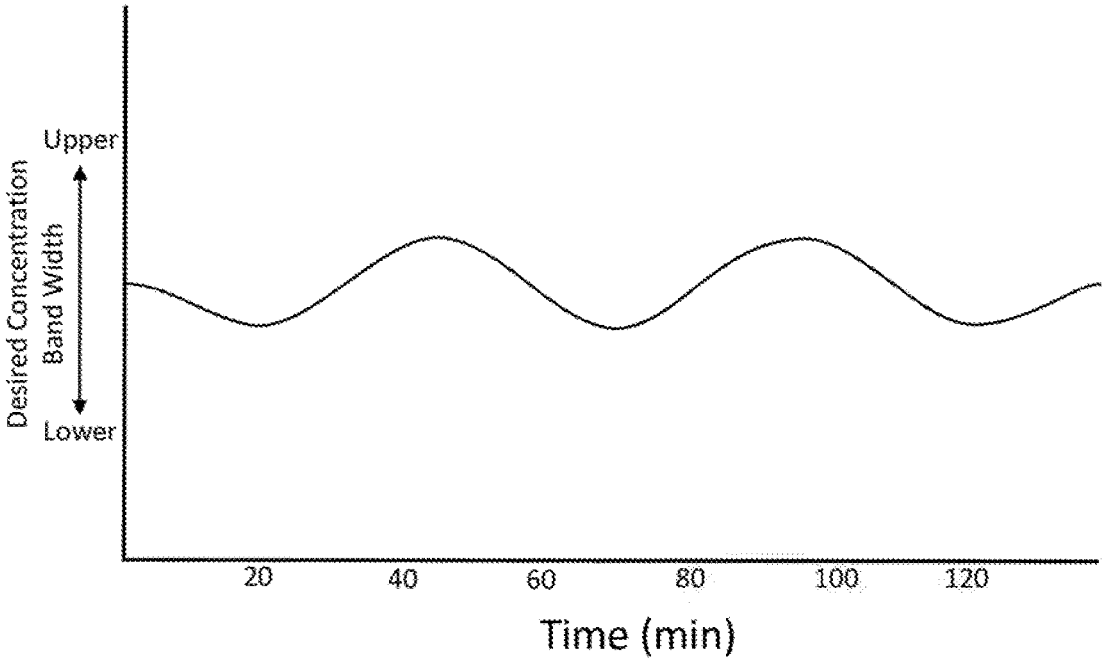
FIG. 8 is a graphic representation of acid concentrations taken in a washer solution reservoir when the concentration within the reservoir is controlled according to a method of the present invention.

To measure surfactant concentration, titration or a dynamic tensiometer may be employed. By doing this, there should be less metal exposure and less spoilage. For example, when a can body corrodes, a coating on the inside of the can body lifts off of the surface. As long as the coating remains intact and sticks to the wall of the can body, it will not later produce a leak. However, if the coating lifts off of the can body inner wall, or if there is no coating in a spot, the can body may subsequently leak when subsequently filled with a beverage. A method of the present invention maintains the acid concentration of the washing solution 204 within a smaller band width. Prior art washer apparatuses maintain the concentration of the washing solution 204 by periodically adding the component 604 in larger patches for example every 15 to 40 minutes, so the concentration in prior art devices follows more of step-wise profile relationship with time, while the method of the present invention follows a smoother profile within a much smaller concentration band width (compare FIGS. 7 and 8).

In the prior art method, a washer apparatus 10 might go 40 minutes without adding the component 604. Such time gaps often result in concentrations that are too high or too low (see FIG. 7) which can lead to metal etching or failure to remove all of the organic soils from the surface of can bodies. This leads to downstream problems at the decorating apparatus and spray areas which coat an inner surface of the can body. This method can result in an acid imbalance wherein a level of acidity caused by the imbalance impacts the amount or degree of etching that occurs on a surface of the can bodies. An undesirable level or degree of this can body surface etching is known to adversely affect loading of can bodies onto mandrels of a decorating apparatus. Can bodies with a greater degree of etching have been found to be more difficult to load onto the mandrels on the decorating apparatus.

The present system relies on instantaneous readings and continuous or more frequent additions of smaller volumes of the component 604 to maintain concentration in the reservoir 200. This leads to a concentration having a smoother relationship over time within a smaller window or desired concentration band width between upper limit concentration and lower limit concentration.

An aspect of the washer apparatus 10 of the present invention is to treat each can body 100 with approximately the same amount of washing solution 204 in approximately the same concentration. However, because the speed of the can body transporter varies, it is difficult to deliver an equal volume of washing solution 204 to each can body 100. The belt speed is dependent on the operation of preceding apparatuses in a can body-making system or factory. Additionally, the washer apparatus 10 is set up to operate with a predetermined can body population density on the can body transporter. Typically, the predetermined can body population density on a can body transporter is called a "full pack" wherein 90 to 95% of an effective surface area (i.e. a usable surface area) of the can body transporter is covered with can bodies 100, preferably 95%±5%. The washer apparatus 10 can operate at a lower can body population density, e.g. 85%, but can body tipping on the can body transporter during processing occurs at higher, less desirable rate or frequency. For example, if a manufacturing malfunction causes a delay, then the can body transporter is slowed to maintain the can body population density at the desired predetermined value because fewer can bodies will reach the can body transporter during a given time period relative to the same time period at full production. In some instances, the speed of the can body transporter can vary 50% or more, for example from 37 ft/min (11.3 m/min) to 15 ft/min (5.6 m/min). It follows that the can body population density is a measure of, or function of, the number of can bodies per unit area of the can body transporter surface, in most cases a belt 11*a* or a mat. Here, a substantially constant can body population density is a variation of ±10% of the average can body density per unit area of the can body transporter, and more preferably ±5.

Typically, in the past, to combat the slowing of the can body transporter, a washing solution 204 output from the pumps 12 to the header pipe 14 is decreased. This reduces a pressure delivered from the spray bars 16*a-h* to the can bodies. This decreases a spray angle, as measured from a vertical axis, delivered from the spray bars 16*a-h* and causes incomplete coverage of the washer solution 204 over the traversing can bodies 100 (compare FIG. 2 to FIG. 3). For example, if the spray bars 16*a-h* are rated for 40 psi (0.28 mpa), at 40 psi (0.28 mpa) pressure in the header pipe 14, the spray bars 16*a-h* may normally spray at a first angle α of 25 degrees. However, when the pressure is lowered, for example to 30 psi (0.21 mpa), the spray angle may decrease to a second angle β of an estimated 19-20 degrees.

Figure 2:
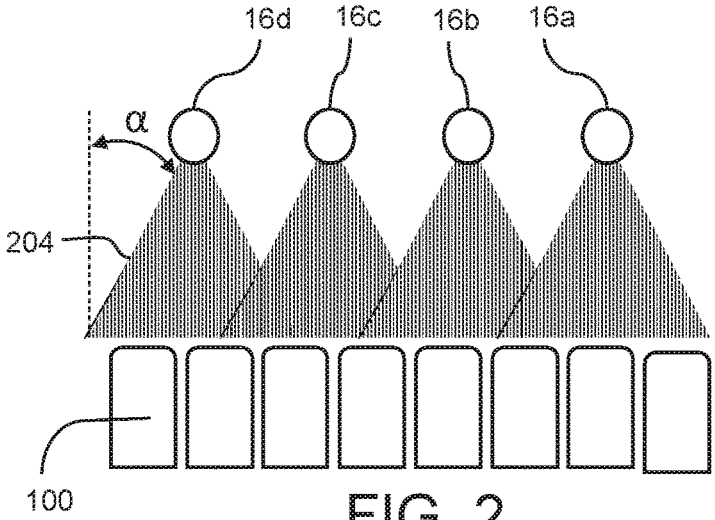
FIG. 2 is a drawing showing washing solution delivered from spray bars in a washer apparatus wherein a delivery angle of the solution from the spray bar to the can bodies overlaps with a delivery angle from an adjacent spray bar.

Under desired conditions, a shaped spray angle delivered from one spray bar 16*a* should overlap a shaped spray angled from an adjacent spray bar 16*b* as illustrated in FIG. 2. If the shaped spray angles do not overlap, as illustrated in FIG. 3, then the can bodies 100 will not receive a full volume of washing solution 204 from the spray bars 16*a-h*. Thus, when the spray angle is changed by decreasing pressure, can body 100 cleaning is compromised because the side walls of the can bodies 100 will not be fully contacted by the washing solution 204.

The present invention utilizes the valves 18*a-h* to shorten an exposure time of the can bodies 100 within or under the washing solution 204. The invention reduces the volume of washing solution 204 delivered to the can bodies 100, while maintaining pressure in the header pipe 14 and the spray bars 16*a*-16*h*. The pumps 12 work to continue maintaining the pressure in the header pipe 14, regardless of whether the valves 18*a-h* are open or closed, to keep the amount or volume of washing solution 204 received by each can body consistent and at least substantially continuous in a plurality of can bodies processed in a que, at least in terms of the delivery spray angle and volume of the washing solution delivered. In other words, when the header pipe 14 pressure is reduced, the amount of washing solution 204 sprayed on the can bodies 100 is less predictable; the predictability is improved by maintaining header pipe pressure. This also maintains the desired spray angle at the first angle α or substantially maintains the first angle α at ±3 degrees.

Thus, one embodiment of the invention is directed to maintaining a constant or substantially constant header pipe 14 pressure, for example at 40 psi±5 psi (0.28 mpa±0.034 mpa). Maintaining pressure in the header pipe 14 allows for a more accurate quantity of washing solution 204 delivered to each can body 100.

In another embodiment of the invention, an angle of a sprayed washing solution 204 remains constant from at least one of a plurality of spray bars when washing solution flow from another of the plurality of spray bars is turned off, ceased, or stopped.

In a method of the present invention, a quantity of acid is continuously added to the washing solution 204 dependent on manufacturing process rate. Additionally, a volume of washing solution 204 delivered to a can body 100 is controlled based on the rate of the manufacturing process. Rather than reducing the pressure at which the washing solutions are delivered, the present invention takes a predetermined number of delivery spray bars out of service as, or when, the manufacturing process rate slows. For example, in a method of the present invention washing solution 204 flow through the spray bars 16*a*,16*b* is terminated by closing valves 18*a*,18*b*. This causes cessation of a delivery of washer solution 204 to the can bodies from these spray bars 16*a*,16*b*.

In another embodiment, a quantity of surfactant is continuously added to the washing solution 204 dependent on manufacturing process rate. Additionally, a volume of washing solution 204 delivered to a can body 100 is controlled based on the rate of the manufacturing process. Rather than reducing the pressure at which the washing solutions are delivered, the present invention takes a predetermined number of delivery spray bars out of service as, or when, the manufacturing process rate slows. For example, in a method of the present invention washing solution 204 flow through the spray bars 16*a*,16*b* is terminated by closing valves 18*a*,18*b*. This causes cessation of a delivery of washer solution 204 to the can bodies from these spray bars 16*a*, 16*b*.

In one illustrative example, the washer apparatus 10 shown in FIG. 1 has a length of about 40 feet long. Each valve 18*a-h* controls a delivery of washing solution 204 from a corresponding spray bar 16*a-h* to the can bodies 100, and each spray bar 16*a-h* delivers washing solution 204 to approximately 28½ feet of the washer apparatus length. Thus, terminating flow to a single spray bar 16*a* by activating valve 18*a* shortens a length of the washer apparatus 10 in which the can bodies 100 receive the washing solution 204 from the spray bars 16*a-h* by 7½ feet. If a second valve 18*b* is also activated to terminate flow to a second spray bar 18*b*, the length of the washer apparatus 10 is reduced by another 7½ feet. If 4 valves 18*a-d* are activated terminating flow to 4 spray bars 16*a-d*, the length of the washer apparatus 10 is effectively cut in half. In which case, can bodies 100 would receive a delivery of washing solution 204 over only about 50% of the length of the washer apparatus 10. This would be used when a belt speed is approximately 50% of a standard speed.

In one illustrative example, when the belt speed is 15 ft/min (4.6 m/min), 4 valves 18*a-d* are closed and 4 of the eight spray bars 16*a-d* do not receive and deliver washing solution 204.

Further, in one embodiment, both liquid solutions 604 are added to the washing solution 204 of the washer apparatus 10 in a continuous manner. Using this approach, signals from the monitor or monitors 500, including installed sensors (conductivity and fluoride probes) in the reservoirs 200, are fed to the controller 400 where the values are compared to desired set points. An offset is fed to pumps 612 relaying corrective action in the way of regulating additions of the acid-based liquid solutions. This is a feedback control system.

In one embodiment, a method of the present invention uses a proportional, integral and derivative algorithm to reduce the offset to zero thereby creating a true steady state mode of operation from an acid concentration point of view. A controller may utilize a software routine stored on a memory which incorporates the proportional, integral and derivative algorithm.

In one embodiment, a method of the present invention uses a proportional, integral and derivative algorithm to control the volume of solution that reaches a surface of each can body by maintaining a set spray pressure and a predetermined exposure time by regulating a series of valves. A net outcome is to provide a clean surface with suitable surface topography (also known as surface finish) that will accept the various downstream coatings and is also suited for loading the can bodies onto the mandrels of a decorating apparatus. A controller may utilize a software routine stored on memory which incorporates the proportional, integral and derivative algorithm.

In one embodiment, the invention provides improved cleaning results by changing an exposure time of the can bodies 100 to the washing solution 204 relative to a washer apparatus 10 can body transporter speed and/or a manufacturing rate of can body making apparatuses in a can body making system wherein such can body making apparatuses are upstream of the washer apparatus 10.

Figure 6:
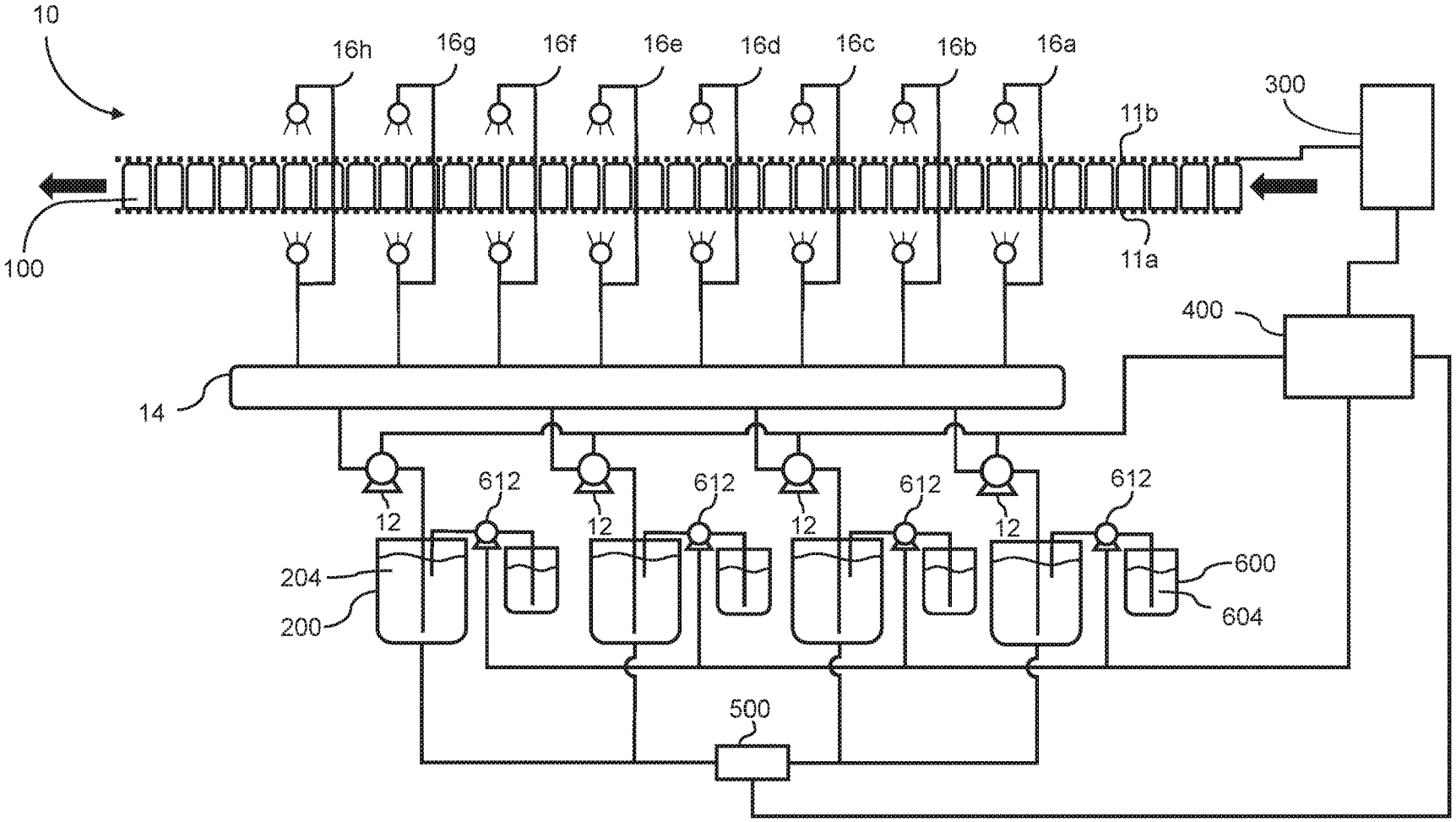
FIG. 6 is a schematic of an upstream stage relative to the stage illustrated in FIG. 1.

In one embodiment illustrated in FIG. 6, a first stage of a washer apparatus 10 is shown wherein a pressure in the header pipe 14 is regulated based on a speed of the can body transporter. The purpose of the first stage is to rinse or clean away heavy oils on the can bodies 100. This first stage washer apparatus is an upstream washer apparatus stage relative to the second stage washer apparatus illustrated in FIG. 1. The washing solution 204 in the first stage includes a lower concentration of sulfuric acid which is a heavier contributor to can body 100 etching than the washing solution provided in the second stage illustrated in FIG. 1.

Summarizing, the present invention provides valves 18*a-h* to a second stage washer apparatus 10 and a continuous feedback signal loop corresponding to acid concentration and/or surfactant concentration readings taken in or from the washing solution 204 within washing solution reservoirs 200 by a monitor or monitors 500. The feedback signal is received by a controller 400 which adds acid and/or surfactant to the reservoirs 200, for example by activating pumps 612. In this manner, an amount of acid and/or surfactant in the reservoirs 200 is continuously adjusted based on the reading received from the monitor 500. Thus, the present invention narrows a band width or range of concentrations over which the stage operates. The present invention utilizes an analog system because it continuously monitors washer solution components from the supply of same 600 to the reservoirs 200. In this way, one goal is to maintain a steady state acid and/or surfactant concentration in the washing solution 204 within the reservoirs 200. In other words, the pumps 612 may operate at different speeds, delivering differing volumes of acid and/or surfactant 604 to the reservoirs 200, but they will generally not stop as long as the stage is operating.

Benefits of the present invention include, but are not limited to: quality improvements because can bodies 100 are more consistently and uniformly cleaned; surface finish improvements of the can bodies 100 and more smooth can body sidewalls due to a reduction in etching; because the surface finish is improved, water spots on the outside of the can bodies and printing voids (i.e. places where there is no ink) are reduced; spoilage is reduced; and can body maker personnel are able to spend less time manually attending to the mandrels on can body decorator apparatuses.

Further, the invention provides an additional benefit. Namely, a historical record database can be established on a computer memory. The historical record contains data corresponding to the volumes and timing of acid and surfactant added to the washing solution, as well as the other parameters such as the corresponding volume of the washing solution delivered and the corresponding can body population density. Thus, if the surfactant or acid concentration measurement means fail, the can body washing process could be continued using historical data without compromising quality to a great degree.

Finally, the inventors contemplate the aspects of the present invention can be practiced on the pre-wash and/or washing stages of an overall can body washing system. Thus, the inventors contemplate that the adjustments described herein can be applied in any stage of the washer system. For example, it can happen in stage 2 (wash), stage 1 (prewash), and/or stage 4 (conversion coating for specialty cans).

While the specific embodiments have been illustrated and described, numerous modifications come to mind without significantly departing from the spirit of the invention and the scope of protection is only limited by the scope of the accompanying Claims.

What is claimed is:

1. A method of improving a washing stage of a plurality of can bodies in a can body manufacturing process comprising a plurality of can body forming apparatuses and a can body decorating apparatus comprising the steps of maintaining a can body population density on a can body transporter through a can body washer apparatus by reducing a speed of the can body transporter in response to a change in a manufacturing rate of an upstream can body forming apparatus, varying an exposure time of the plurality of can bodies to a washing solution in response to the speed of the transporter by reducing a first flow of the washing solution through a first flow bar relative to a second flow of the washing solution through a second flow bar, continuously monitoring a concentration of a component in the washing solution, and continuously adding a volume of the component to the washing solution in response to the monitoring of the concentration.

2. The method of claim 1 wherein the first flow of the washing solution is substantially eliminated in response to a decrease in the manufacturing rate of the upstream can body forming apparatus.

3. A method of cleaning can bodies having a continuous sidewall closed at one end by an integral bottom portion opposite an open end, the method comprising the steps of:

substantially continuously monitoring a concentration of a component within a washing solution using an electronic monitor;

sending a signal corresponding to a concentration of the component in the washing solution from the monitor to a controller; and controlling activation of an electronic regulator in response to the signal which controls volumetric additions of the component to the washing solution, wherein the washing solution comprises an acid component and a surfactant component, and the method further comprises the step of maintaining an acid concentration and a surfactant concentration within the washing solution located in a reservoir by sending a signal corresponding to an actual concentration of the acid component within the washing solution to the controller wherein the controller outputs an activation signal to the electronic regulator responsive to the signal which triggers an automated addition of the acid component to the reservoir to increase the acid concentration in the washing solution and by sending a second signal corresponding to an actual concentration of the surfactant component within the washing solution to the controller wherein the controller outputs a second activation signal to a second regulator responsive to the second signal which triggers an automated addition of the surfactant component to the reservoir to increase the surfactant concentration in the washing solution.

4. The method of claim 3 wherein the controller uses a proportional integral and derivative routine to reduce an offset of the solution component concentration to zero wherein a true steady state mode of operation in the washing solution component concentration in the washing solution.

5. The method of claim 3 wherein the step of substantially continuously monitoring a concentration of a component within a washing solution using an electronic monitor is performed continuously.

6. The method of claim 3 wherein the step of controlling activation of the electronic regulator is performed substantially continuously such that volumetric additions of the component are substantially continuously added to the washing solutions.

7. The method of claim 6 wherein the step of controlling activation of the electronic regulator is performed continuously such that volumetric additions of the component are continuously added to the washing solutions.

8. The method of claim 6 further comprising the step of populating a can body transporter with a plurality of can bodies, wherein the transporter transfers can bodies through a can body washer apparatus from an entry end to a delivery end of the can body washer apparatus, wherein a plurality of spray bars located between the entry end and the delivery end delivers a washing solution to the plurality of can bodies, and wherein the step of controlling activation of the electronic regulator is performed continuously while the transporter is transferring can bodies from the entry end to the delivery end of the can body washer apparatus.

9. The method of claim 8 further comprising the step of maintaining a substantially constant can body population density on the can body transporter by controlling a speed of the can body transporter based on a rate of production of can bodies produced by a can body manufacturing apparatus upstream of the can body washer apparatus.

10. The method of claim 9 further comprising the step of controlling a time duration of an exposure of the plurality of can bodies to the washing solution by regulating delivery of the washing solution from the spray bars.

11. The method of claim 10 wherein the controlling the time duration step includes reducing a first flow of the washing solution through a first spray bar wherein the first flow through the first spray bar is negligible relative to a second flow of the washing solution through a second spray bar.

12. The method of claim 11 wherein the controlling the time duration step includes sending a signal from a controller to a valve located between a reservoir of the washing solution and the first spray bar to substantially eliminate the first flow.

13. A method of cleaning can bodies having a continuous sidewall closed at one end by an integral bottom portion opposite an open end, the method comprising the steps of:

populating a can body transporter with a plurality of can bodies, wherein the transporter transfers can bodies through a can body washer apparatus from an entry end to a delivery end of the can body washer apparatus, wherein a plurality of spray bars located between the entry end and the delivery end delivers a washing solution to the plurality of can bodies;

maintaining a substantially constant can body population density on the can body transporter by controlling a speed of the can body transporter relative to a rate of production of can bodies produced by a can body manufacturing apparatus upstream of the can body washer apparatus; and controlling a time duration of an exposure of the plurality of can bodies to the washing solution by regulating delivery of the washing solution from the spray bars.

14. The method of claim 13 wherein the controlling the time duration step includes maintaining a substantially constant spray angle measured from a vertical axis of the washing solution delivered from a first spray bar in the plurality of spray bars.

15. The method of claim 13 wherein the washing solution is fed from a source of washing solution to a header pipe and from the header pipe to the plurality of spray bars, wherein a pressure within the header pipe is maintained substantially constant as the controlling the time duration step is performed.

16. The method of claim 13 wherein an angle of a sprayed washing solution as measured from a vertical axis remains substantially constant from a first spray bar when a flow of the washing solution through a second spray bar is substantially stopped.

17. The method of claim 13 wherein a controller uses a proportional, integral and derivative algorithm to control a volume of washing solution that reaches the plurality of can bodies by maintaining a substantially constant spray pressure in a header pipe that delivers the washing solution to the plurality of spray bars and by controlling the exposure time of the plurality of can bodies to the washing solution by regulating a series of valves.

18. The method of claim 13 wherein the controlling the time duration step includes reducing a first flow of the washing solution through a first spray bar wherein the first flow through the first spray bar is negligible relative to a second flow of the washing solution through a second spray bar.

19. The method of claim 18 wherein the controlling the time duration step includes sending a signal from a controller to a valve located between a reservoir of the washing solution and the first spray bar to substantially eliminate the first flow.

20. The method of claim 13 wherein the washing solution comprises an acid component and a surfactant component, and the method further comprises the step of maintaining an acid concentration and a surfactant concentration within the washing solution located in a reservoir by sending a signal corresponding to an actual concentration of the acid component within the washing solution to a controller wherein the controller outputs an activation signal to a regulator responsive to the signal which triggers an automated addition of the acid component to the reservoir to increase the acid concentration in the washing solution and by sending a second signal corresponding to an actual concentration of the surfactant component within the washing solution to a controller wherein the controller outputs a second activation signal to a second regulator responsive to the second signal which triggers an automated addition of the surfactant component to the reservoir to increase the surfactant concentration in the washing solution.

21. The method of claim 20 further comprising the step of establishing a historical database stored on a computer memory including data related to volumes and timing of additions of the acid component and the surfactant component to the washing solution and including a software routine on the computer memory which uses the historical data to control the acid and surfactant concentrations in the washing solution on a substantially continuously basis.

22. The method of claim 13 wherein a volume of washing solution delivered to the plurality of can bodies is reduced while maintaining a pressure in a header pipe which delivers the washing solution to the plurality of spray bars.

23. The method of claim 22 wherein a spray angle as measured from a vertical axis from at least one of the spray bars in the plurality of spray bars is maintained substantially constant.

24. The method of claim 13 further comprising the step of maintaining a concentration of a washing solution component within the washing solution located in a reservoir by sending a signal corresponding to an actual concentration of the washing solution component within the washing solution to a controller wherein the controller outputs an activation signal to a regulator responsive to the signal which triggers an automated addition of the washing solution component to the reservoir to increase the concentration of the washing solution component in the washing solution.

25. The method of claim 24 wherein the concentration is an acid concentration.

26. The method of claim 24 wherein the concentration is a surfactant concentration.

* * * * *